US005944861A

United States Patent [19]

MacKenzie et al.

[11] Patent Number: 5,944,861

[45] Date of Patent: Aug. 31, 1999

[54] PROCESS AND APPARATUS FOR MAKING EXPANDED SLAG

[75] Inventors: Peter A. MacKenzie; David T. Horvat, both of Stoney Creek, Canada

[73] Assignee: Lafarge Canada Inc., Hamilton, Canada

[21] Appl. No.: 08/994,763

[22] Filed: Dec. 19, 1997

[30] Foreign Application Priority Data

Jun. 13, 1997 [CA] Canada ..... 2207780

[51] Int. Cl.[6] ..... C03B 5/18; C03B 19/08

[52] U.S. Cl. ..... 65/19; 65/20; 65/141; 241/15; 241/39; 425/8

[58] Field of Search ..... 65/19, 20, 141; 241/15, 39; 425/8

[56] References Cited

U.S. PATENT DOCUMENTS

| | | | |
|---|---|---|---|
| 56,595 | 7/1866 | Morris et al. | 65/19 |
| 1,047,370 | 12/1912 | Bergquist | 65/19 |
| 3,594,142 | 7/1971 | Margesson et al. | 65/19 |
| 4,115,089 | 9/1978 | Metz et al. | 65/19 |
| 4,153,440 | 5/1979 | Legille et al. | 65/19 |
| 4,171,965 | 10/1979 | Schockmel | 65/19 |
| 4,414,016 | 11/1983 | Orlander et al. | 65/141 |
| 4,451,221 | 5/1984 | Orlander et al. | 425/446 |
| 4,461,636 | 7/1984 | Gagneraud et al. | 65/141 |

FOREIGN PATENT DOCUMENTS 55-28347 2/1980 Japan .

*Primary Examiner*—Sean Vincent

[57] ABSTRACT

Metallurgical slag is expanded to produce a lightweight solid by forming a stream of molten liquid slag of controlled rate of flow and mixing the stream of slag with a controlled quantity of water and flowing the interacting mixture of slag and water into a receptacle. The interaction between slag and water is allowed to proceed for a predetermined period of time to form an expanded solid without the addition of any additional cooling water which would otherwise quench the material and vitrify it. In the receptacle, a vaned rotor operates to segment the interacting mixture of slag and water and project the segmented mixture through the air for collection into a heap.

13 Claims, 3 Drawing Sheets

PROCESS AND APPARATUS FOR MAKING EXPANDED SLAG

FIELD OF THE INVENTION

This invention relates to the treatment of slag to transform it into a useful product. In particular, the invention provides means to change molten blast furnace slag into a lightweight solid used as an aggregate in the fabrication of concrete products.

BACKGROUND OF THE INVENTION

Early efforts to recover slag for end uses outside of the metallurgical environment comprised dumping the slag into an open pit holding a pool of water. The quenched slag would cool and solidify, generating steam that escaped through the slag, thereby producing an "expanded" lightweight product much like natural pumice. The process has the disadvantage of producing copious quantities of gaseous by-products which escape into the atmosphere and it therefore does not comply with modern environmental standards.

It is also slow, being a batch process, and the cooled slag must be treated further to provide an aggregate of uniform size and make it useful.

Processes for pelletizing slag have been developed, in which molten slag is fed continuously with a quantity of water toward a rotary drum having radially-extending vanes, whereby cooled slag is projected into the air for further cooling and, conveniently, is deposited into a heap of discrete, uniform pellets. Such a process is described in Applicant's U.S. Pat. No. 3,594,142. The resulting product is in the form of pellets which are easily handled. However, the pellets which are vitrified and relatively dense, cannot be considered to be a "foamed" slag or an "expanded" slag and they are unsuitable for use in lightweight concrete and similar applications requiring a lightweight aggregate.

In U.S. Pat. No. 1,047,370, molten slag is fed into a stream of water under pressure towards a rotating wheel which carries a multitude of "beater blades" loosely pivoted on their support rods and which stand out radially from the wheel when it is rotated at high speeds of about 7,000 feet per minute. The combined action of steam and water and beaters upon the slag disintegrates the slag into small fragments which are flung through the air and collected in a pile. It is believed that the resulting product does not expand and is unsuitable for use as a lightweight aggregate.

In U.S. Pat. No. 56,595, molten slag is also fed to a rotary drum which, in this case, carries a series of arms extending radially and obliquely around the periphery of the drum. The drum is disposed inside a housing which holds a pool of water to quench hot, molten slag. The slag is granulated and broken by the sudden change in temperature and carried forward by the arms, which operate like an auger, to be scooped and delivered outside apparatus. The resulting product is believed to be vitrified and unsuitable for use as a lightweight aggregate.

An object of this invention is to provide means for producing an expanded, lightweight slag in a continuous process.

SUMMARY OF THE INVENTION

In accordance with the invention, there is provided a process for expanding metallurgical slag to produce a lightweight solid, the process including the steps of:

(a) forming a stream of molten liquid slag of controlled rate of flow;

(b) mixing the said stream of molten liquid slag with a controlled quantity of water to produce an interacting mixture of slag and water;

(c) flowing the interacting mixture of slag and water into a receptacle having a closed bottom for containing the interacting mixture of slag and water, and allowing the interacting mixture of slag and water to interact for a predetermined period of time to form an expanded slag product;

(d) segmenting the expanded slag product; and (e) projecting the segmented expanded slag product through the air for collection into a heap.

In accordance with another aspect of the invention, there is also provided apparatus for carrying out the process, the apparatus being characterized by a receptacle with a curved bottom and an open top through which said interacting mixture is received at a receiving end and discharged at a discharge end; and a rotary drum disposed for rotation on a longitudinal axis thereof inside said receptacle, the drum carrying at least one vane having a length and a height, the height extending radially a predetermined distance from the surface of the drum, the length of said at least one vane extending over at least a portion of the length of the drum, the vane being adapted to segment an expanded slug product of slag and water upon rotation of the rotary drum into the path of movement of a flowing interacting mixture of slag and water and to push said expanded slag product towards said discharge end of the receptacle with a centrifugal force sufficient to project the segmented expanded slag product through the open top of the receptacle for collection into a heap.

In a preferred form of the apparatus, the rotary drum carries a pair of vanes disposed on radially opposite sides of the drum, a first vane having a length extending from one end of the drum towards a midpoint of the drum, the other vane having a length extending from the other end of the drum towards said midpoint, to balance the drum.

BRIEF DESCRIPTION OF THE DRAWINGS

In order that the invention may be more clearly understood, a preferred embodiment is described below with reference to the accompanying drawings, in which.

DETAILED DESCRIPTION OF PREFERRED EMBODIMENT

The process according to the invention is conveniently carried out using apparatus for pelletizing metallurgical slag which has been modified for the purposes of the invention. As in the case of a pelletizer, molten slag is directed from a blast furnace (not shown) and fed via a runner 20 to the apparatus generally indicated by numeral 22 housed within an enclosure 23.

Figure 2:
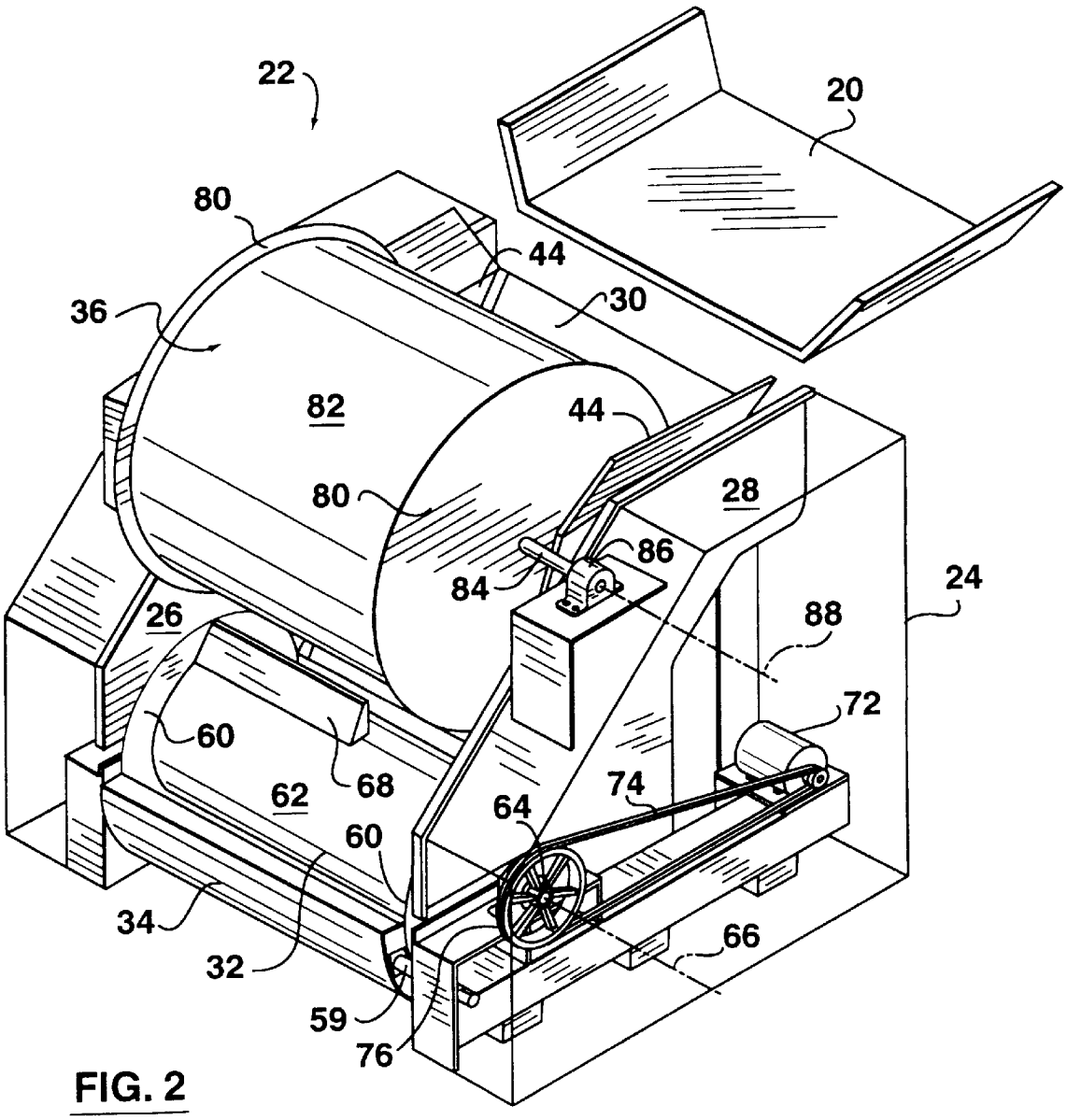
FIG. 2 is a perspective view of the apparatus of FIG. 1.

The apparatus consists of an apparatus frame, indicated by the numeral 24 (FIG. 2) and consisting of two spaced side frame members 26, 28 between which are supported the principal operative elements of the apparatus, namely a downwardly-inclined feed plate 30, a first vaned projecting rotor 32, an open receptacle 34 receiving the rotor 32, and a second deflecting rotor 36.

Figure 1:
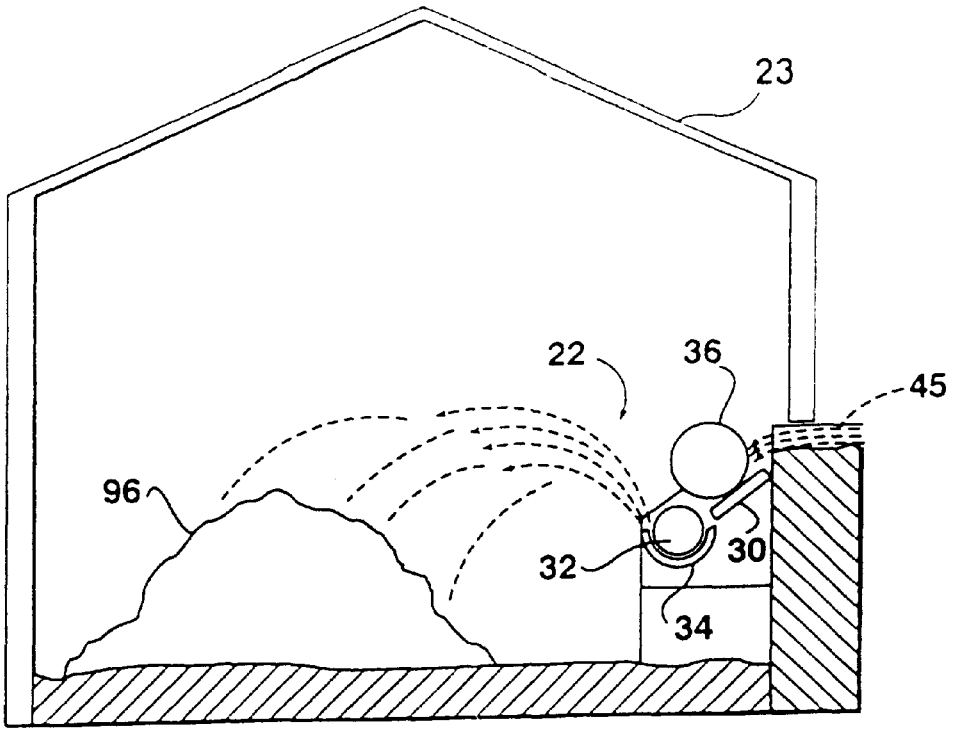
FIG. 1 is a schematic side elevation view of the apparatus used to carry out the process in accordance with the invention housed in an enclosure.
Figure 3:
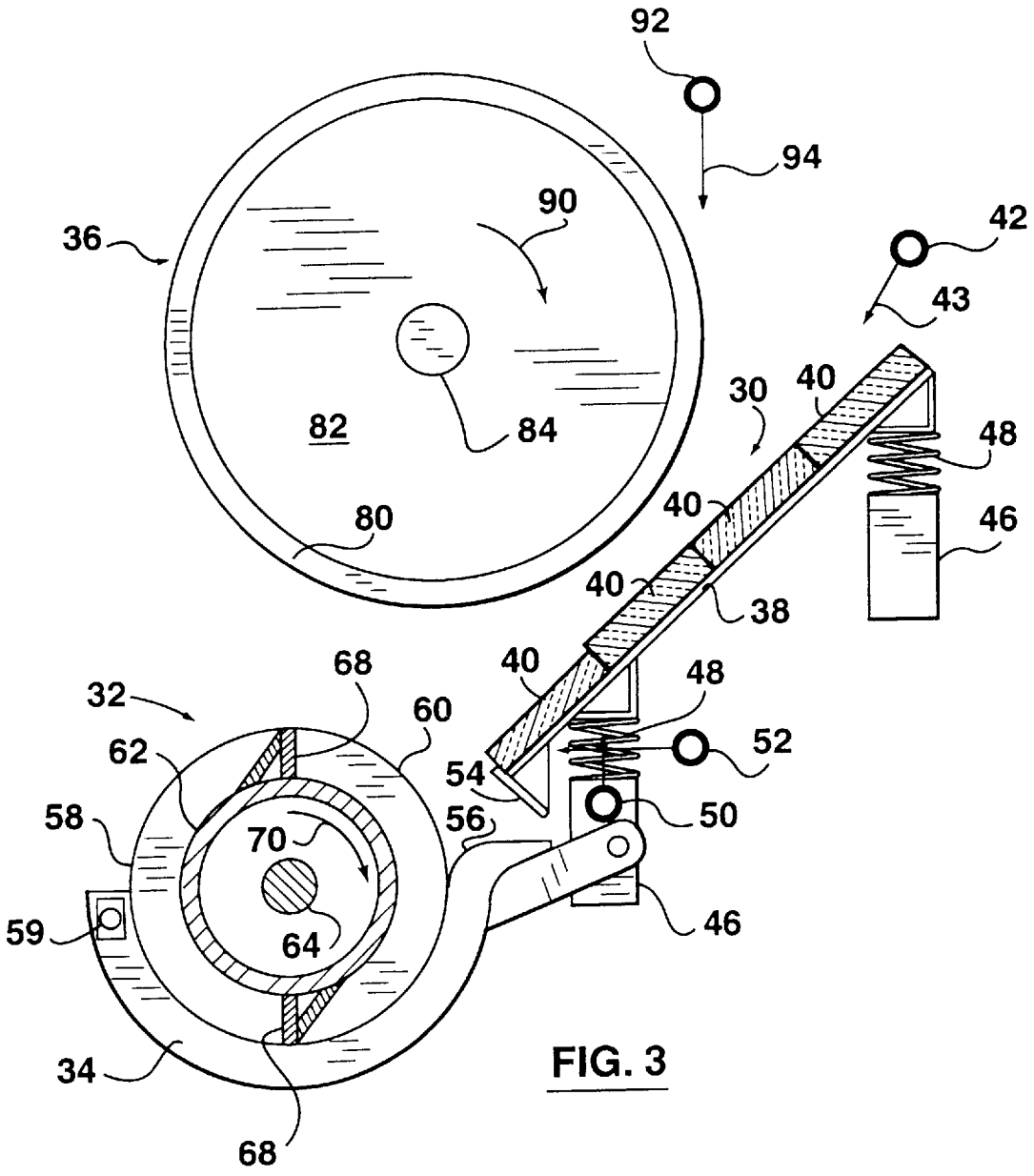
FIG. 3 is a side elevation of the apparatus of FIG. 2.

As will be seen more clearly in FIG. 3, the feed plate 30 consists of a flat metal base plate 38 supporting a plurality of blocks 40 of highly heat-resistant material, such as graphite, the upper surfaces of which constitute an interaction feed surface. Water, supplied from water pipe 42 having nozzles (not shown), is directed as indicated by arrow 43 onto the surface of a stream of molten liquid slag 45 (FIG. 1) flowing down the inclined feed plate 30 and interacts with the slag. Preferably, the slag flow rate is controlled to a range of 1 to 3 tonnes per minute while the rate of flow of water is from 100 to 300 gallons per minute. Side walls 44 (FIG. 1) are provided to confine the interacting mixture of slag and water to the surface of the feed plate 30 and the entire feed plate is spring-mounted on the apparatus frame 24 and constantly vibrated to assist in preventing any adhesion of the interacting mixture of slag and water to the surface. Thus, the feed plate 30 is supported from standards 46 of the frame 24 by interposed compression coil springs 48 disposed with their compression axes vertical. A random vibration is produced by the impact of the interacting mixture of slag and water flowing on the feed plate and this is superimposed upon a constant force vibration produced by a rotating eccentric weight (not shown).

Additional cooling water is directed from water pipe 50 to the underside of the base plate 38 and from water pipe 52 to a toe plate 54 disposed at the discharge end of the feed plate 30 where the interacting mixture of slag and water leaves the feed plate and enters the receptacle 34.

The receptacle 34 has a curved bottom and an open top defining a receiving end 56 adjacent to the feed plate 30 and a discharge end 58 remote from the feed plate which, in the industry, will be commonly referred to as a "spoon". The receptacle 34 is dimensioned to receive a drum comprising the vaned rotor 32 and comprises a hollow jacket made from sheet steel and water-cooled by a water pipe 59.

The vaned rotor 32 consists of two spaced parallel circular side plates 60 between which extends a horizontally-disposed drum 62 of circular cross-section co-axial with a drive shaft 64 on which it is mounted for rotation about a horizontal axis 66, the periphery of the drum 62 being provided with a pair of radially outwardly-extending vanes 68. The drum 62 rotates clockwise as indicated by directional arrow 70 in FIG. 3 of the drawings, that is, in a direction towards the interacting mixture of slag and water emerging from the feed plate 30 and being fed into the receiving end 56 of the receptacle 34. The drum 62 is driven from a motor 72 via a belt 74 and pulley 76.

Figure 4:
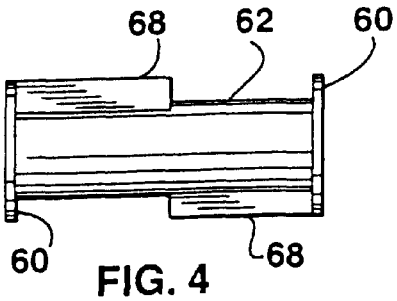
FIG. 4 (drawn adjacent to FIG. 1) is a schematic side elevation of a drum forming part of the apparatus of FIG. 1.
Figure 5:
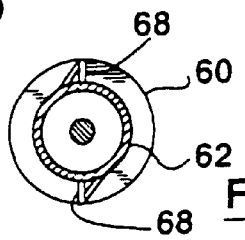
FIG. 5 (drawn adjacent to FIG. 4) is a schematic end elevation of the drum of FIG. 4.

The position and configuration of the vanes 68 on the surface of the drum 62 is very important to the operation of the process in accordance with the invention. As will be seen from FIGS. 4 and 5, each vane 68 is disposed on opposite sides of a drum 62 so that when one vane rotates to the top of the drum, the opposite vane will have reached the bottom of the drum. Each vane 68 has a length which extends from a respective end of the drum adjacent to the side plates 60 towards a midpoint of the drum. In this way, the vaned rotor assembly 32 is balanced and at least one vane is associated with a respective longitudinal segment of the drum.

Typically, the drum which has an outside diameter of 24 in. is rotated to have a peripheral speed of from 30 to 42 feet per second, each vane 68 extending 6 in. from the surface of the drum and being adapted to segment the interacting mixture of slag and water exiting from the feed plate 30 as it enters the receiving end 56 of the receptacle 34. The drum itself has a length of six feet and the vanes 68 are spaced a small distance from the interior of the receptacle, typically leaving a gap which is less than one half inch. The interacting mixture of slag and water continues to interact as it flows down the receptacle 34 and is carried forward towards the discharge end 58 by the vanes 68, and therefore has an increased residence time necessary to produce a lightweight, expanded slag product. As the rotor 32 completes a revolution through the receptacle 34, each vane 68 operates to project any material carried ahead of the vane through the air for collection into a heap.

The assembly of the apparatus 22 is completed by the deflecting rotor 36 which also consists of two spaced parallel end plates 80 between which extends a horizontal cylinder 82 of circular cross-section co-axial with its drive shaft 84, the ends of which are mounted in respective bearing blocks 86 for rotation about a horizontal axis 88 toward the feed plate 30 as indicated by directional arrow 90. The drive shaft 84 is spaced from the drive shaft 64 for the vaned rotor 32 at a height selected to deflect any projected material downstream into the heap and prevent the material from re-entering the receiving end 56 of the receptacle 34.

The position of the bearing blocks 86 may be adjusted in order to vary the height separating the deflecting rotor 36 from the vaned rotor 32 and additional cooling water is supplied by water pipe 92 and directed as indicated by arrow 94 onto the surface of the rotor 36.

The apparatus 22 provides a continuous means of expanding metallurgical slag and existing pelletizing apparatus such as described in our prior U.S. Pat. Nos. 3,594,142 and 4,451,221 may easily be converted to produce an expanded slag product. It will be appreciated that the necessary conversions would require the addition of the open receptacle 34 and modification of the vaned rotor 32 to reduce the number of vanes 68 as, otherwise, the interacting mixture of slag and water would be projected prematurely by several vanes upon each successive rotation of the rotor and would not be given sufficient opportunity to interact in the receptacle.

In use, it will be appreciated that an interaction between slag and water begins when the water is added to the slag stream flowing onto the feed plate 30. While the residence time for interaction could arguably be prolonged by increasing the length of the feed plate 30, this would require a commensurate increase in the height of the feed plate above the ground and complicate to an appreciable extent the conversion of existing facilities to operate a process in accordance with the invention. The interacting mixture of slag and water which leaves the feed plate 30 is physically supported by the receptacle 34 which is disposed below the feed plate and receives the interacting mixture of slag and water via a gravity discharge. The interactions between slag and water continue in the receptacle and may be observed as a continuous series of audible explosions as the mixture proceeds from the receiving end to the discharge end of the receptacle. The purpose of the vanes 68 is two-fold, in that they each present a leading sharp edge which operates to sever the interacting mixture and a sloping trailing edge which is, in part, adapted to support the leading edge and also to deflect any impacts from explosions between the interacting slag and water mixture. The second function of the vanes is to project any segmented material carried forward of the vanes so that it will exit from the receptacle with sufficient force to land in a heap 96 FIG. 1) removed from the apparatus where it can be carted away, as and when required.

It will be appreciated that several variations may be made to the above-described embodiment of the invention within the scope of the appended claims. In particular, it is to be understood that the configuration and shape of the vanes may vary and specific examples of such variations are shown in FIGS. 6 to 9.

Figure 6:
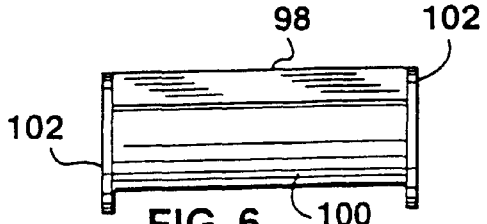
FIG. 6 (drawn adjacent to FIG. 1) is a schematic side elevation of a first alternative embodiment of a drum for use in a process according to the invention.
Figure 7:
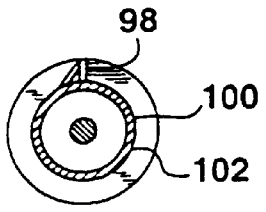
FIG. 7 (drawn adjacent to FIG. 6) is a schematic end elevation of the drum of FIG. 6

In FIGS. 6 and 7, only a single vane 98 is provided extending across the entire length of the associated drum 100. The drum 100 is mounted between respective side plates 102.

Figure 8:
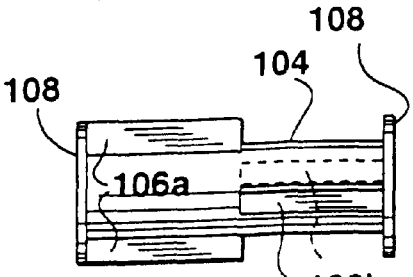
FIG. 8 (drawn adjacent to FIG. 1) is a schematic side elevation of a second alternative embodiment of a drum for use in a process according to the invention.
Figure 9:
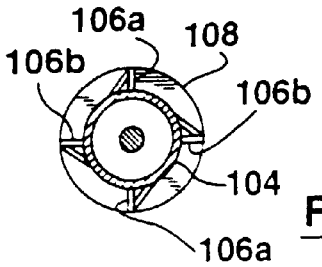
FIG. 9 (drawn adjacent to FIG. 8) is a schematic end elevation of the drum of FIG. 8.

In FIGS. 8 and 9, a drum 104 has four radially-staggered vanes 106 of which a first pair 106*a* occupy a longitudinal segment of the drum between one side plate 108 and the midpoint of the drum, and a second pair 106*b* occupy a longitudinal segment of the drum between the opposite side plate 108 and the midpoint of the drum. Each vane 106 is radially-staggered by 90° so that the vanes in a pair (106*a*, 106*b*) are on opposite sides of the drum. It will be appreciated that this arrangement of the vanes allows the drum to be balanced, thereby facilitating the operation and maintenance of the apparatus.

Other variations will be apparent to those skilled in the art. It must be appreciated that the additional residence time provided in the receptacle 34 will be compromised if too many vanes are provided where such vanes successively project material from the receptacle for each rotation of the drum. Finally, it will also be appreciated that the receptacle 34 is water-cooled through water pipe 59 and that no fresh water is added to the interior of the receptacle itself, thereby limiting the amount of water and preventing the interacting mixture of slag and water from being quenched which would otherwise arrest any continuing reaction and vitrify the resulting material.

We claim:

1. A process for expanding metallurgical slag to produce a lightweight solid, the process including the steps of:

(a) forming a stream of molten liquid slag of controlled rate of flow;

(b) mixing the said stream of molten liquid slag with a controlled quantity of water to produce an interacting mixture of slag and water;

(c) flowing the interacting mixture of slag and water into a receptacle having a closed bottom for containing the interacting mixture of slag and water, and allowing the interacting mixture of slag and water to interact for a predetermined period of time to form an expanded slag product;

(d) segmenting the expanded slag product; and (e) projecting the segmented expanded slag product through the air for collection into a heap.

2. Process according to claim 1 in which the stream of molten liquid slag and water are mixed by spraying water onto the surface of molten liquid slag flowing down an inclined feed plate.

3. Process according to claim 1 in which the receptacle has a curved bottom adapted to accommodate a rotating drum and an open top through which said interacting mixture of slag and water is received at a receiving end and an expanded slag product is discharged at a discharge end.

4. Process according to claim 3 in which a rotary deflector is disposed upstream from said discharge end of the receptacle at a height selected to deflect any projected material from entering said receiving end of the receptacle.

5. Process according to claim 1 in which the expanded slag product is segmented by a rotary drum disposed for rotation on a longitudinal axis there of inside said receptacle, the drum carrying at least one vane having a length and a height, the height extending radially a predetermined distance from the surface of the drum, the length of said at least one vane extending over at least a portion of the length of the drum.

6. Process according to claim 1 in which the segmented expanded slag product is projected by a rotary drum disposed for rotation on a longitudinal axis thereof inside said receptacle, the drum carrying at least one vane having a length and a height, the height extending radially a predetermined distance from the surface of the drum, the length of said at least one vane extending over at least a portion of the length of the drum.

7. Process according to claim 1 in which the rate of flow of the slag in said stream is from 1 to 3 tonnes per minute, while the rate of flow of water is from 100 to 300 gallons per minute.

8. Process according to claim 1 in which the drum is rotated to have a peripheral speed of from 30 to 42 feet per second.

9. Apparatus for carrying out a process of expanding metallurgical slag, the apparatus having means for forming a stream of molten liquid slag having a controlled rate of flow;

means for mixing said stream of molten liquid slag with a controlled quantity of water to produce an interacting mixture of slag and water;

a receptacle with a curved bottom and an open top through which said interacting mixture of slag and water is received at a receiving end and an expanded slag product is discharged at a discharge end; and a rotary drum disposed for rotation on a longitudinal axis thereof inside said receptacle, the drum carrying at least one vane having a length and a height, the height extending radially a predetermined distance from the surface of the drum, the length of said at least one vane extending over at least a portion of the length of the drum, the vane being adapted to segment an expanded slag product upon rotation of the rotary drum into the path of movement of a flowing interacting mixture of slag and water and to push said expanded slag product towards said discharge end of the receptacle with a centrifugal force sufficient to project the segmented expanded slag product through the open top of the receptacle for collection into a heap.

10. Apparatus according to claim 9 having a rotary deflector disposed upstream from said discharge end of the receptacle at a height selected to deflect any projected material from entering said receiving end of the receptacle.

11. Apparatus according to claim 9 in which the rotary drum carries a single vane having a length extending from one end of the drum to the other end of the drum.

12. Apparatus according to claim 9 in which the rotary drum carries a pair of vanes disposed on radially opposite sides of the drum, a first vane having a length extending from one end of the drum towards a midpoint of the drum, the other vane having a length extending from the other end of the drum towards said midpoint to balance the drum.

13. Apparatus according to claim 9 in which the rotary drum carries a plurality of vanes, each having a length which extends over a portion of the length of the drum, the vanes being radially staggered from each other to balance the drum.

* * * * *

UNITED STATES PATENT AND TRADEMARK OFFICE

CERTIFICATE OF CORRECTION

PATENT NO. : 5,944,861

DATED : August 31, 1999

INVENTOR(S) : MacKenzie et al

It is certified that error appears in the above-identified patent and that said Letters Patent is hereby corrected as shown below:

Column 1 line 54: after "outside" insert --the--;
Column 2 line 18: after "and" insert --an expanded slag product is--;
Column 2 line 26: replace "slug" with --slag--; and
Column 2 line 26: delete "of slag and water".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*